US006318314B1

(12) United States Patent
Otto et al.

(10) Patent No.: US 6,318,314 B1
(45) Date of Patent: Nov. 20, 2001

(54) DEVICE FOR SETTING THE MOVEMENT BEHAVIOR OF GAS-EXCHANGE VALVES OF AN INTERNAL COMBUSTION ENGINE

(75) Inventors: Erhard Otto, Moosburg; Gerd Rösel, Regensburg; Wolfgang Schulte, München; Hong Zhang, Tegernheim, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/648,954

(22) Filed: Aug. 28, 2000

Related U.S. Application Data

(63) Continuation of application No. PCT/EP99/01180, filed on Feb. 24, 1999.

(30) Foreign Application Priority Data

Feb. 27, 1998 (DE) ..... 198 08 354

(51) Int. Cl.[7] ..... F01L 1/344
(52) U.S. Cl. ..... 123/90.15; 123/90.17
(58) Field of Search ..... 123/90.15, 90.16, 123/90.17, 90.18, 90.31

(56) References Cited

U.S. PATENT DOCUMENTS

| | | | | |
|---|---|---|---|---|
| 5,363,817 | | 11/1994 | Ikeda et al. | 123/90.15 |
| 5,562,071 | * | 10/1996 | Urushihata et al. | 123/90.15 |
| 5,611,304 | * | 3/1997 | Shinojima | 123/90.15 |
| 5,680,834 | * | 10/1997 | Szpak et al. | 123/90.15 |
| 5,787,848 | * | 8/1998 | Stefanopoulou et al. | 123/90.15 |

FOREIGN PATENT DOCUMENTS

| | | |
|---|---|---|
| 39 42 052 A1 | 6/1991 | (DE) . |
| 42 30 074 A1 | 3/1994 | (DE) . |
| 43 06 509 C1 | 3/1994 | (DE) . |
| 42 40 631 A1 | 6/1994 | (DE) . |
| 44 08 425 A1 | 12/1994 | (DE) . |
| 43 31 977 A1 | 3/1995 | (DE) . |
| 43 40 614 C2 | 6/1995 | (DE) . |
| 44 13 443 A1 | 10/1995 | (DE) . |
| 195 41 769 A1 | 5/1997 | (DE) . |
| 196 22 555 A1 | 12/1997 | (DE) . |
| 0 445 555 A2 | 9/1991 | (EP) . |
| 0 483 243 B1 | 5/1992 | (EP) . |
| 2 288 037 A | 10/1995 | (GB) . |

OTHER PUBLICATIONS

Patent Abstracts of Japan No. 60–190610 (Thoshinaru), dated Sep. 28, 1985.

* cited by examiner

*Primary Examiner*—Weilun Lo
(74) *Attorney, Agent, or Firm*—Herbert L. Lerner; Laurence A. Greenberg; Werner H. Stemer

(57) ABSTRACT

A device for setting movement behavior of gas-exchange valves of an internal combustion engine with a camshaft. The device has a control unit that generates a setting signal for a setting element of a setting device that adjusts the camshaft. A pilot control system is provided which additively corrects the setting signal including determining an estimated value for adjusting the camshaft without taking account of the delay time of the setting device.

6 Claims, 3 Drawing Sheets

DEVICE FOR SETTING THE MOVEMENT BEHAVIOR OF GAS-EXCHANGE VALVES OF AN INTERNAL COMBUSTION ENGINE

CROSS-REFERENCE TO RELATED APPLICATION

This is a continuation of copending International Application PCT/EP99/01180, filed Feb. 24, 1999, which designated the United States.

BACKGROUND OF THE INVENTION

Field of the Invention

The invention relates to a device for setting the movement behavior of gas-exchange valves of an internal combustion engine having a camshaft. A control unit generates a setting signal which controls an adjustment of the camshaft. A pilot control system is additionally provided for additively correcting the setting signal.

An appliance for rotating a camshaft relative to the crankshaft in an internal combustion engine is known from German Patent DE 43 40 614 C2. The appliance has a control unit that generates a setting signal as a function of the deviation of an actual position of the camshaft from a required position. The setting signal is multiplicatively corrected by a correction factor that is determined as a function of a rotational speed and an oil temperature. Such appliances exhibit significant delay times, which reduce the maximum achievable control rate. It has been found, in practice, that the control unit can be parametrically organized either in such a way that a step in the required position is followed up only slowly or in such a way that there is a rapid follow-up to a step in the required position with the consequence of a small stability reserve. A rapid follow-up of steps in the required position is, however, necessary in order to also ensure comfortable operation of the internal combustion engine in transient operation with, at the same time, a low fuel consumption and high power.

SUMMARY OF THE INVENTION

It is accordingly an object of the invention to provide a device for setting the movement behavior of gas-exchange valves of an internal combustion engine which overcomes the above-mentioned disadvantages of the prior art devices of this general type, in which a comfortable operation of the internal combustion engine is also ensured in transient operation and with, at the same time, a low fuel consumption and high power.

With the foregoing and other objects in view there is provided, in accordance with the invention, a device for setting movement behavior of gas-exchange valves of an internal combustion engine having a camshaft. The device includes a setting device having a setting element to be connected to the camshaft and being a system subject to a delay time. A control unit is connected to the setting element and generates a setting signal received by and controlling the setting element for adjusting the camshaft. A pilot control system for additively correcting the setting signal is connected to the control unit. The pilot control system determines an estimated value for adjusting the camshaft without taking account of the delay time of the setting device. The pilot control system correcting the setting signal in dependence on the estimated value and a specified required value.

The solution presented by the invention is distinguished by the fact that the movement behavior of the gas-exchange valves can be adjusted very rapidly with surprising simplicity. Thus, the desired movement behavior of the gas-exchange valves can be ensured for each current operating condition of the internal combustion engine. In addition, the control unit only has to provide compensation for inaccuracies in the pilot control system.

In accordance with an added feature of the invention, the pilot control system corrects the setting signal in dependence on a load parameter, a rotational speed and an oil temperature.

In accordance with an additional feature of the invention, the control unit determines the setting signal in dependence on a measured value and a further estimated value for the adjustment of the camshaft which takes account of the delay time.

In accordance with another feature of the invention, an integrator is connected to the control device and integrates the setting signal and only outputs an integrated setting signal to the setting element if the integrated setting signal exceeds a specified threshold value.

In accordance with another added feature of the invention, the setting signal is determined cyclically from a cycle time, and synchronously with a rotational speed of the internal combustion engine. A physical model of the setting device being provided by which the estimated value is determined, taking account of the cycle time.

In accordance with a concomitant feature of the invention, the estimated value is determined in dependence on the rotational speed and an adjustment rate of the camshaft.

Other features which are considered as characteristic for the invention are set forth in the appended claims.

Although the invention is illustrated and described herein as embodied in a device for setting the movement behavior of gas-exchange valves of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
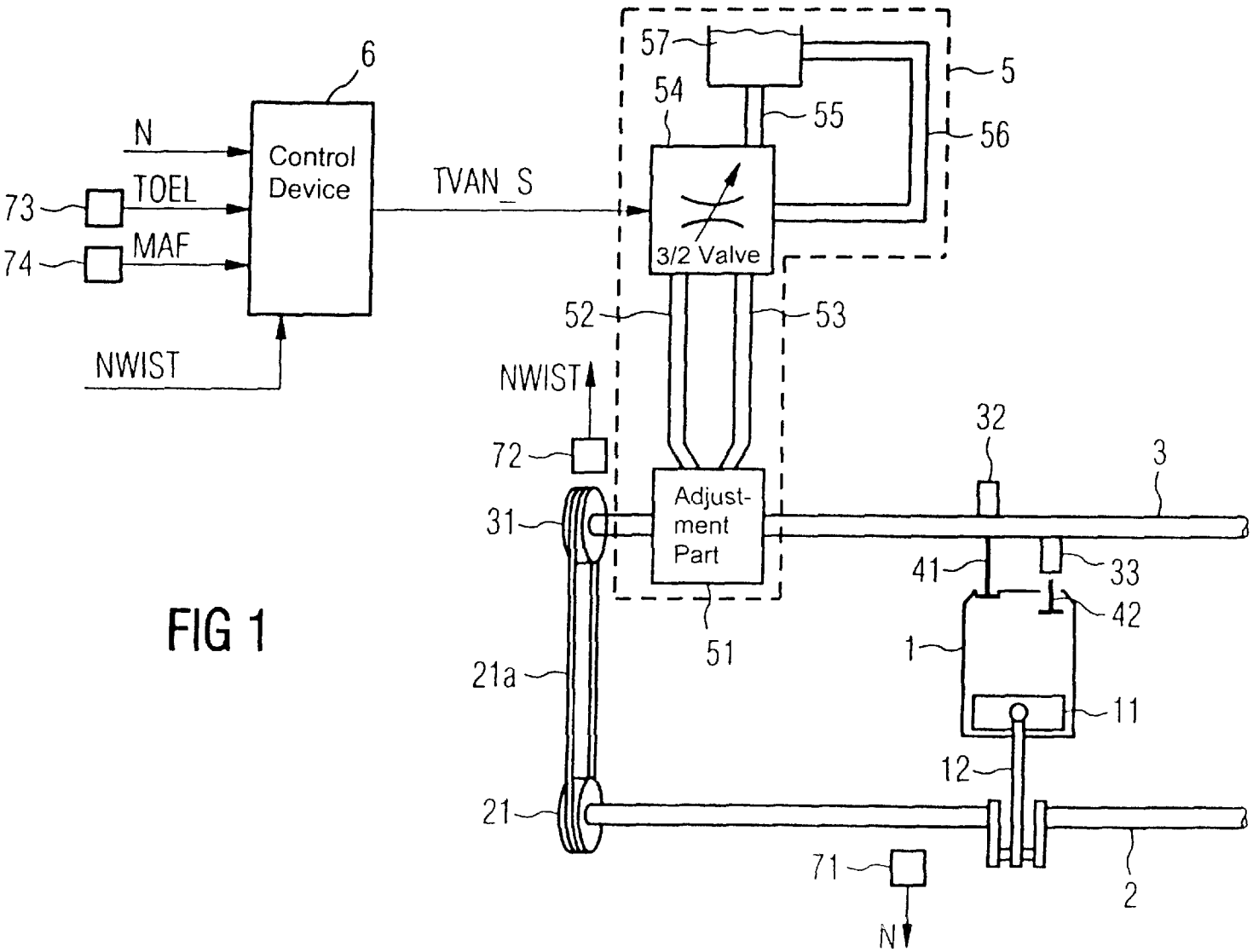
FIG. 1 is a diagram of an internal combustion engine.

In all the figures of the drawing, sub-features and integral parts that correspond to one another bear the same reference symbol in each case. Referring now to the figures of the drawing in detail and first, particularly, to FIG. 1 thereof, there is shown an internal combustion engine which has a cylinder 1 with a piston 11 and a connecting rod 12. The connecting rod 12 is connected to the piston 11 and a crankshaft 2. A first toothed wheel 21 is disposed on the crankshaft 2. The first toothed wheel 21 is mechanically connected by a chain 21*a* to a second toothed wheel 31, which is disposed on a camshaft 3. The camshaft 3 has cams 32, 33 which act on gas-exchange valves 41, 42. In FIG. 1, the internal combustion engine is shown with one cylinder. he internal combustion engine can, of course, also have a plurality of cylinders.

A setting device 5 for setting the movement behavior of the gas-exchange valves 41, 42 is associated with the internal combustion engine. The setting device 5 has a mechanical adjustment part 51, which is connected by hydraulic lines 52, 53 to a setting element 54, which is preferably configured as a hydraulic 3/2-way valve. The setting element 54 is connected to an oil reservoir 57 by a high-pressure hydraulic line 55 and a low-pressure hydraulic line 56, an oil pump being also associated with the oil reservoir 57, if required. A control device 6 is provided with associated sensors for recording various quantities to be measured and determining, in each case, the measured value of the quantity to be measured. The control device 6 determines a setting signal TVAN_S for the setting element 54 as a function of the quantities to be measured.

The sensors are configured as a rotational speed sensor 71, which records a rotational speed N and a crankshaft angle KW of the crankshaft 2, a camshaft angle sensor 72, which records camshaft angle NW, an airflow meter 74, which records an air mass flow MAF, or an oil temperature sensor 73, which records an oil temperature TOEL. Depending on the embodiment of the invention, an arbitrary subset of the sensors mentioned, or even additional sensors, can be present.

Figure 2:
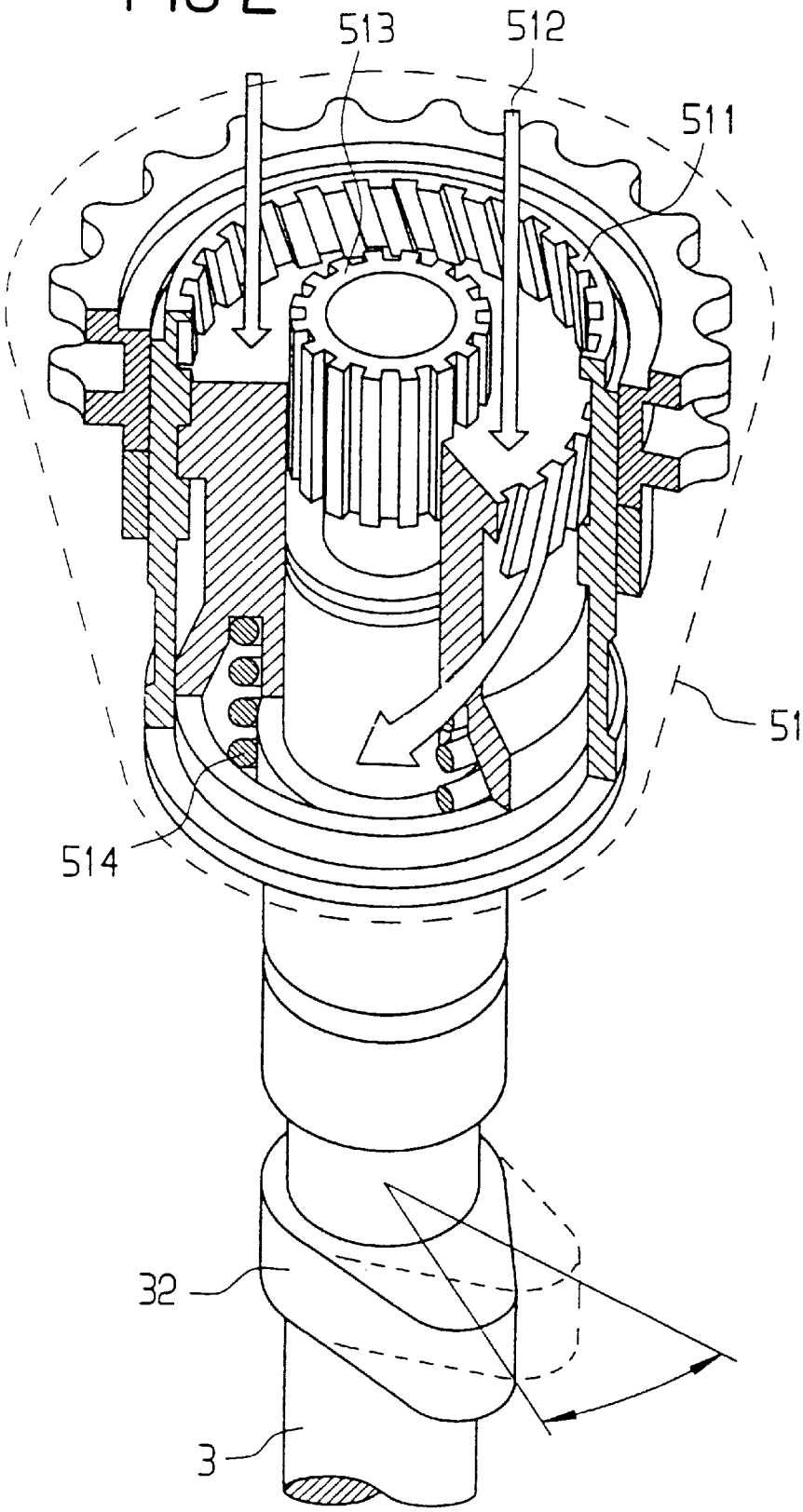
FIG. 2 is a partially, cut-away sectional and perspective view of a camshaft with a section through a mechanical adjustment part.

FIG. 2 shows the camshaft 3 with the mechanical adjusting part 51 in a sectional representation. The second toothed wheel 31 is associated with the mechanical adjusting part 51, the former being positively connected to a third toothed wheel 511. The third toothed wheel 511 has helical teeth that engage in associated helical teeth of a toothed ring 512. On the inside, the toothed ring 512 has straight teeth that engage in correspondingly configured teeth of a fourth toothed wheel 513. The toothed ring 512 is displaced axially relative to the camshaft 3 as a function of the oil pressure in the hydraulic lines 52, 53. A spring 514 is provided for returning the toothed ring 512 to a specified rest position when no forces, caused by the oil pressure in the lines 52, 53, act on the toothed ring 512.

The setting device 5 permits phase adjustment of the camshaft 3 relative to the crankshaft 2. In consequence, the phase can be continuously adjusted within a specified range. The beginning and end of the lift of the gas-exchange valves 41, 42 can therefore be varied.

Figure 3:
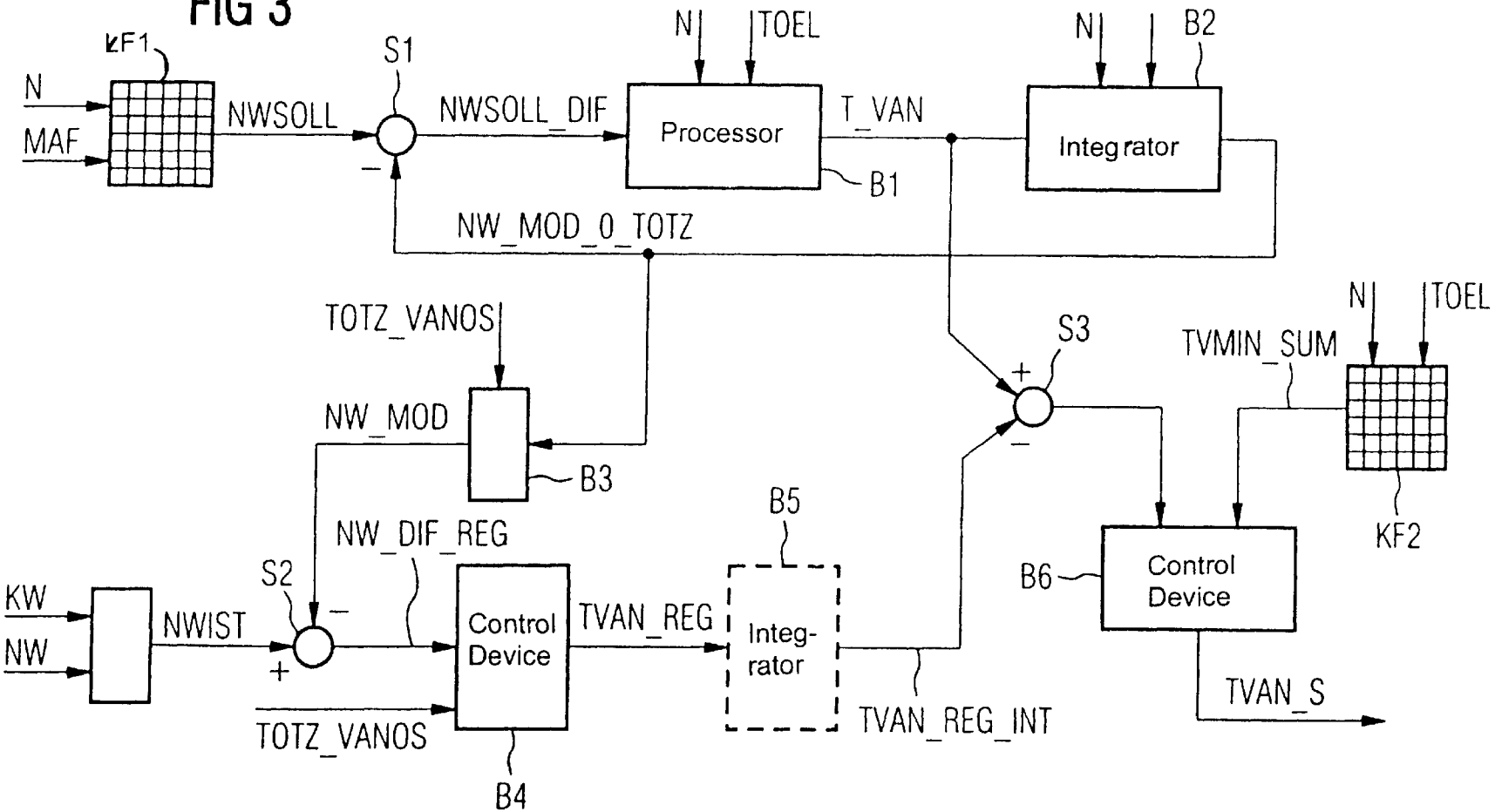
FIG. 3 is a block circuit diagram of a device for setting a movement behavior of gas-exchange valves according to the invention.

FIG. 3 shows a block circuit diagram of the control device 6, which controls the setting of the movement behavior of the gas-exchange valves 41, 42. A required value NWSOLL for the adjustment of the camshaft 3 is determined from a first characteristic diagram KF1 as a function of the rotational speed N of the crankshaft 2 and the air mass flow MAF or another load parameter.

A pilot control system has a summation station S1, in which the difference NWSOLL_DIF between the required value NWSOLL and an estimated value NW_MOD_O_TOTZ of the adjustment of the camshaft 3 is determined without taking a delay time TOTZ_VANOS of the setting device 5 into account. A pilot control value T_VAN of a flow duration of the 3/2-way valve 54 is determined in a processing block B1 as a function of the difference NWSOLL_DIF of the rotational speed N and the oil temperature TOEL. The determination of the pilot control value T_VAN takes place cyclically with a specified cycle time, preferably synchronously with the rotational speed.

A block B2 simulates the path behavior of the setting device 5 and contains, for example, an integrator which, without taking the delay period TOTZ_VANOS into account, determines the estimated value NW_MOD_O_TOTZ of the adjustment of the camshaft 3 as a function of the pilot control value T_VAN, a cycle duration, the rotational speed N and an adjustment rate of the camshaft, which has been determined. The delay time TOTZ_VANOS is caused by an excitation time of electromagnets of the 3/2-way valve 54, a behavior of the hydraulic system at different oil viscosities, a build-up of oil pressure at low rotational speeds N and a configuration of the 3/2-way valve 54 per se. Because the delay period of the setting device 5 is not taken into account in the estimated value NW_MOD_O_TOTZ, a feedback of the estimated adjustment of the camshaft, which actually also arrives at the camshaft 3 after the delay time has elapsed, takes place during each calculation cycle of the pilot control value T_VAN. The pilot control system is therefore extremely precise and independent of the delay time of the setting device 5.

An estimated value NW_MOD for the adjustment of the camshaft is determined in a processing block B3 taking account of the delay time of the setting device 5. This takes place as a function of the delay time TOTZ_VANOS of the setting device 5, which is determined from a characteristic diagram as a function of the rotational speed N, the air mass flow MAF and the oil temperature TOIL. The difference between the measured value NWIST and the estimated value NW_MOD of the adjustment of the camshaft is determined in a second summation station S2. The measured value NWIST of the adjustment of the camshaft 3 is determined as a function of the recorded crankshaft angle KW and camshaft angle NW.

A control unit B4, which determines a control value TVAN_REG of the flow duration of the 3/2-way valve 54 as a function of the difference NW_DIF_REG between the actual value NWIST and the estimated value NW_MOD and as a function of the delay time TOTZ_VANOS, is provided. The control unit B4 is preferably configured as a P control unit. It can, however, also be configured as a PI or PID control unit or some other control unit known to the specialist. In this arrangement, the control unit B4 is preferably an adaptive configuration and, in fact, such that the control parameters are a function of the delay time TOTZ_VANOS.

A block B5 is preferably provided which contains an integrator, which integrates the control value TVAN_REG until it exceeds a minimum duration T_MIN_VAN of the 3/2-way valve flow. When the integrated control value T_VAN_REG_INT exceeds the minimum duration T_MIN_VAN, the integrated control value is output to a third summation station S3 and the integrator B5 is reset again. This permits even small control differences, which lead to flow times which are located in the tolerance range of the setting device 5, to be controlled out. A block B6 checks whether the difference between the pilot control value T_VAN and the integrated control value T_VAN_REG_INT of the duration of the 3/2-way valve flow has a magnitude which is larger than the minimum duration T_MIN_V of the 3/2-way valve flow. It is only in this case that electricity is supplied, for the period TVAN_S, to the respective electromagnet of the 3/2-way valve 54. This increases the life of the setting device 5, particularly that of the 3/2-way valve 54, because it is not supplied with electricity so often during the operation of the internal combustion engine.

The control unit B4 only has to compensate for inaccuracies in the pilot control system. In consequence, the follow-up to the adjustment of the camshaft 3 can take place very rapidly.

Furthermore, the control device 6 is distinguished by the fact that the pilot control system transposes to the position specified at a very high - generally maximum - adjustment rate, independently of the system delay time. The permissible range of fluctuations in the delay time is high for the control system. In consequence, the robustness of the control circuit is substantially increased without any measurable deterioration in the control quality and control rate. The invention is not limited to the embodiment example described. The adjusting part 51 can also, for example, be configured in such a way that the lift behavior of the gas-exchange valves 41, 42 can be varied.

We claim:

1. A device for setting movement behavior of gas-exchange valves of an internal combustion engine having a camshaft, the device comprising:

a setting device having a setting element to be connected to the camshaft and being a system subject to a delay time;

a control unit connected to said setting element and generating a setting signal received by and controlling said setting element for adjusting the camshaft; and a pilot control system for additively correcting the setting signal and connected to said control unit, said pilot control system determining an estimated value for adjusting the camshaft without taking account of the delay time of said setting device, and said pilot control system correcting the setting signal in dependence on the estimated value and a specified required value.

2. The device according to claim 1, wherein said pilot control system corrects the setting signal in dependence on a load parameter, a rotational speed and an oil temperature.

3. The device according to claim 1, wherein said control unit determines the setting signal in dependence on a measured value and a further estimated value for the adjustment of the camshaft which takes account of the delay time.

4. The device according to claim 1, including an integrator connected to said control device and integrates the setting signal and only outputs an integrated setting signal to said setting element if the integrated setting signal exceeds a specified threshold value.

5. The device according to claim 1, wherein the setting signal is determined cyclically from a cycle time, and synchronously with a rotational speed of the internal combustion engine, and including a physical model of said setting device being provided by which the estimated value is determined, taking account of the cycle time.

6. The device according to claim 5, wherein the estimated value is determined in dependence on the rotational speed and an adjustment rate of the camshaft.

* * * * *

UNITED STATES PATENT AND TRADEMARK OFFICE

CERTIFICATE OF CORRECTION

PATENT NO. : 6,318,314 B1
DATED : November 20, 2001
INVENTOR(S) : Erhard Otto et al.

It is certified that error appears in the above-identified patent and that said Letters Patent is hereby corrected as shown below:

Title page,
Item [73], should read as follows:

-- Assignee: Siemens Aktiengesellschaft; Bayerische Motoren Werke Aktiengesellschaft, both of München --

Signed and Sealed this

Nineteenth Day of November, 2002

*Attest:*

*Attesting Officer*

JAMES E. ROGAN
*Director of the United States Patent and Trademark Office*